United States Patent [19]

Mesman

[11] Patent Number: 4,660,525

[45] Date of Patent: Apr. 28, 1987

[54] CARBURETOR MIXTURE CONTROLLER APPARATUS

[76] Inventor: Alexander H. Mesman, 13058 Hedda La., Cerritos, Calif. 90701

[21] Appl. No.: 746,936

[22] Filed: Jun. 20, 1985

Related U.S. Application Data

[63] Continuation-in-part of Ser. No. 575,073, Jan. 30, 1984, abandoned.

[51] Int. Cl.[4] ..... F02M 23/08; F02M 25/08

[52] U.S. Cl. ..... 123/525; 123/587; 261/DIG. 19; 261/DIG. 67

[58] Field of Search ..... 123/437, 525, 527, 575, 123/576, 577, 578, 587, 25 R, 25 L; 261/DIG. 19, DIG. 67

[56] References Cited

U.S. PATENT DOCUMENTS

| | | | |
|---|---|---|---|
| 2,472,270 | 4/1956 | McClain | 261/DIG. 19 |
| 2,969,800 | 1/1961 | Skirvin et al. | 123/587 X |
| 4,290,403 | 9/1981 | Ziniades | 123/587 X |
| 4,344,406 | 8/1982 | Minor et al. | 123/587 |

FOREIGN PATENT DOCUMENTS

| | | | |
|---|---|---|---|
| 2361505 | 6/1975 | Fed. Rep. of Germany | 123/587 |

*Primary Examiner*—Tony M. Argenbright

*Attorney, Agent, or Firm*—Fulwider, Patton, Rieber, Lee & Utecht

[57] ABSTRACT

An adaptor flange for fitting under the mounting flange of a carburetor of an internal combustion engine and formed with a venturi type flow passage having perforated induction tube spanning thereacross for sensing the magnitude of the partial vacuum in such passage. A controller housing is connected on one end with an air filter and is formed with an induction throat leading to a control chamber. Disposed in the induction throat is a nozzle which is, in turn, connected with the carburetor float chamber. Mounted in the control chamber are first and second pressure responsive valves. Such valves are connected through air/fuel vapor lines to the induction tubes and are responsive to predetermined engine conditions, as sensed in said flow passage, to cooperate therewith in selectively varying the flow rate through said induction throat to correspondingly vary the mixture to the intake manifold.

12 Claims, 3 Drawing Figures

FIG. 1
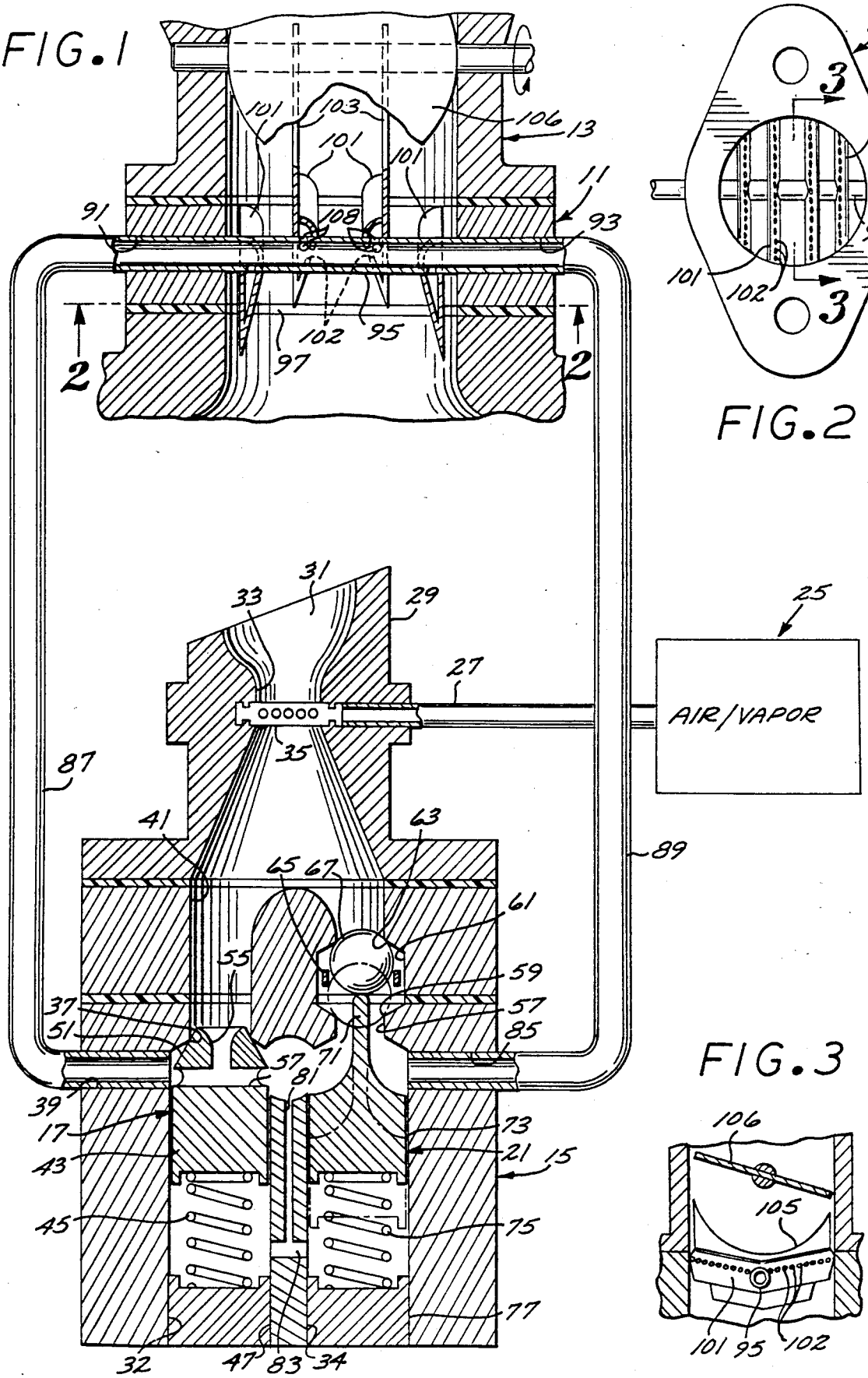
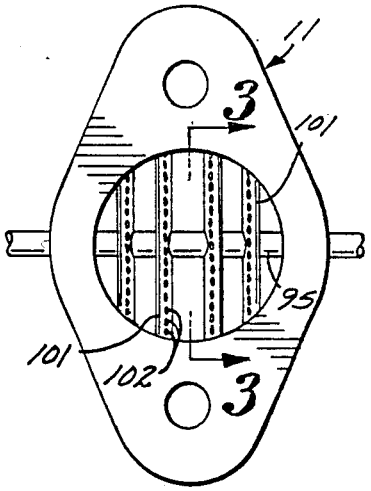
FIG. 2
FIG. 3

CARBURETOR MIXTURE CONTROLLER APPARATUS

REFERENCE TO RELATED APPLICATIONS

This application is a continuation-in-part of my U.S. patent application Ser. No. 575,073, filed Jan. 30, 1984 and now abandoned.

BACKGROUND OF THE INVENTION

1. Field of the Invention

The present invention relates to a control apparatus for varying the fuel pressure in the carburetor to control the rate at which auxillary air and fuel vapor is introduced to the intake manifold of an internal combustion engine to thereby increase the efficiency of combustion, to lower fuel consumption, reduce emission, smooth out engine operation, shorten the period during which choking of the engine is required and improve engine performance during start-up and warming thereof.

2. Description of the Prior Art

Numerous efforts have been made to improve the efficiency of internal combustion engines and reduce emission of partially combusted fuel. These efforts have led to proposals contemplating preheating of fuel and vapor introduced to the engine and to controls which increase the introduction of vapor in proportion to the magnitude of partial vacuum sensed in the intake manifold. A device of this type is shown in U.S. Pat. No. 4,334,422 to Mahoney.

Other efforts have led to proposals which provide for introduction of atomized vapor when the engine is loaded (U.S. Pat. No. 1,974,865) and single vapor control valves which totally close during times when additional water is ideally needed for enhanced combustion, U.S. Pat. No. 4,342,288.

Still further efforts have led to the development of fluid injection systems of the type shown in U.S. Pat. Nos. 4,300,483 and 3,865,907.

However, none of the prior art devices known to applicant provide for complete control of the rate at which air and fuel vapor are introduced to the intake manifold over the entire range of engine operation to thereby vary the fuel pressure in the carburetor, smooth out performance and provide economical performance and reduce emission at all stages of operation.

SUMMARY OF THE INVENTION

The carburetor air/fuel vapor control apparatus of the present invention is characterized by a controller having a first valve which is operative in response to the magnitude of partial vacuum in the intake manifold of an internal combustion engine to progressively open in direct proportion to the magnitude of such partial vacuum to control flow of air/fuel vapor to a carburetor manifold. A mixture of air and fuel vapor is thus introduced to an adapter flange beneath such carburetor for mixture with the air and fuel flowing through such carburetor to decrease the magnitude of partial vacuum in the intake manifold to retard the rate at which fuel is drawn into such carburetor and enhance combustion. A second control valve is responsive to a predetermined level of partial vacuum in the intake manifold to open to increase the flow rate of air and fuel vapor to the intake manifold to thereby decrease the fuel pressure in the carburetor to thereby enhance the efficiency of combustion. At even higher magnitudes of partial vacuum, the second valve will be opened thereby increasing the flow rate of auxillary air and fuel vapor to the intake manifold to thereby decrease the fuel pressure in the carburetor.

The objects and advantages of the present invention will become apparent from a consideration of the following detailed description when considered in conjunction with the accompanying drawings.

DESCRIPTION OF THE DRAWINGS

FIG. 1 is a diagrammatic view, partially broken away of a carburetor air and vapor control apparatus embodying this present invention;

FIG. 2 is a transverse sectional view taken along the line 2—2 of FIG. 1; and FIG. 3 is a transverse sectional view taken along the line 3—3 of FIG. 2.

DETAILED DESCRIPTION OF THE PREFERRED EMBODIMENT

The carburetor air/fuel vapor control apparatus of the present invention includes, generally, an adaptor flange 11 for installation beneath a carburetor 13 of an internal combustion engine for receiving a mixture of air and fuel vapor from a controller 15. The controller 15 includes a load free valve, generally designated 17 responsive to the extremely high magnitudes of partial vacuum in the intake manifold, as for instance during deceleration and unloaded high and low R.P.M.'s, to which the carburetor 13 is connected for progressively increasing the rate of air and vapor flow to such manifold in direct proportion to the magnitude of the partial vacuum in such manifold to thereby decrease the fuel pressure in the carburetor. A load valve, generally designated 21 is responsive to moderate partial vacuums in the intake manifolds, as at low R.P.M.'s under load, to open and rather abruptly increase the rate of air and fuel vapor flow and then to close as the R.P.M.'s increase to decrease the rate of auxillary air and vapor flow thus permitting the partial vacuum in the manifold to maintain a relatively high magnitude.

The controller 15 is intended to control flow of air and fuel vapor from the carburetor float chamber depicted diagrammatically by the block generally designated 25. An air/fuel vapor line 27 leads from the carburetor float chamber 25 to an upper stem 29 formed on top of the controller housing 15. The stem 29 is formed with an induction passage 31 having a reduced incross-section induction throat 33. Disposed in the throat 33 is a perforated nozzle 35 through which air and fuel vapor may be drawn into the throat 33. Mounted on the stem is a conventional air filter (not shown).

The controller 15 is formed with a housing having a pair of upstanding side by side bores 32 and 34 formed therein for receiving the respective valves 17 and 21. The bore 32 projects upwardly and is reduced in cross-section to form a circular downward facing shoulder defining a valve seat 37 below which is located a radially outwardly extending vacuum port 39. Formed in the controller housing 15 diametrically opposite the vacuum port 39 is a second vacuum port 85. Projecting upwardly from the valve seat 37 is a flow passage 41 leading from the induction throat 33.

Received in the bore 32 is a valve piston 43 biased upwardly by means of a compression spring 45 interposed between such piston and a valve plug 47 which closes the bottom end of the bore 32. The valve piston 43 is formed at its top extremity with a frusto conical poppet 51 having formed centrally therein upwardly opening axial, calibrated flow passage 55. The passage 55 is calibrated to provide flow of the desired rate when the valve 17 is closed and joins at its bottom end with radially outwardly leading ports 57 which are in communication with the oppositely disposed vacuum ports 39 and 85.

The valve bore 34 is formed in its upper extremity with a reduced end cross-section neck 57 which forms at the upper end thereof an upwardly facing circular valve seat 59. Formed above the valve seat 59 is an enlarged in cross-section ball chamber 61 formed at its bottom end with the seat 59 and at its upper end with a downwardly facing circular valve seat 63. The seat 63 is in communication with the induction throat 33. Mounted centrally in the chamber 61 is a ring shaped ball cage 65 for maintaining vertical alignment therein of a ball poppet 67 which floats between the seats 59 and 63. The ball poppet 67 is urged upwardly by means of a valve stem 71 formed in the upper extremity of a control piston 73 received telescopically in the bore 34, such biasing being by means of a compression spring 75 sandwiched between such piston and a plug 77 inserted into the lower end of the bore 34.

Formed between the valve bores 32 and 34 is a coextensive bleed passage 81 which is open on its top end for communication with the induction throat 33 and ports 39 and 85 and which joins at its bottom end with cross ports 83 leading to the bores 32 and 34 at a location beneath the respective pistons 43 and 73.

Formed beneath the seat 59 is the radially outwardly projecting bore 85 defining a vacuum port. Received in the respective vacuum ports 39 and 85 are the respective one ends of vacuum lines 87 and 89 which themselves lead upwardly to the opposite sides of the adaptor flange 11 and have their respective opposite ends received in diametrical bores 91 and 93. The lines 91 and 93 then connect with the opposite ends of a manifold tube 95 disposed in the flow passage 97 of the adaptor flange 11 and has mounted thereon a plurality of transverse perforated induction tubes 101 which are somewhat V-shaped in side view and are in communication with the interior of the tube 95 by means of bores 108. In transverse section view the tubes 101 have a streamlined cross-sectional shape in the form of half a tear drop and are perforated to eject the air/fuel vapor mixture through the perforations 102 into the flow passage 97. The central pair of tubes 101 have their exterior sides formed by the respective one extremity of lamination plates 103 which project longitudinally of the flow passage 97 and are formed with semi-circular cutouts 105 for clearance of the valve plate 106 (FIG. 3). These lamination plates 103 serve to streamline flow through the flow passage 97 and enhance the venturi effect of the reduced end cross-sectional flow area through that passage.

In operation, it will be appreciated that the adaptor flange 11 may conveniently be installed under the mounting flange of a conventional carburetor 13. The controller 15 may be installed through the air cleaner housing of the carburetor with an air cleaner (not shown) mounted over the air inlet 31. The air/fuel vapor line 27 may then be connected with the float chamber 25 of the carburetor 13.

When the engine is started it will be appreciated that a partial vacuum is created in the intake manifold communicated through the vacuum port 39, thus communicating a negative pressure to the vacuum ports 35 and 89. Such negative pressure at the port 39 will cause a pressure drop across the length of the calibrated passage 55 in the poppet 51 thereby drawing air and fuel vapor from the induction throat 33 to the venturi throat 97. The partial pressure communicated to the poppets 51 and 67 during starting conditions is at a level to lift the ball poppet 67 off its seat but insufficient to open the valve 17. In practice the passage 55 is calibrated for the particular characteristics of the engine on which the controller of present invention is to be mounted such that sufficient flow is afforded during start up conditions while restricting flow sufficiently when the engine is unloaded and operating at high R.P.M.'s, cruising without a load or decelerating to provide sufficient pressure drop across the poppet 51 to overcome the bias of the spring 45 to allow the valve 17 to open.

The bias of the spring 75 is selected to provide sufficient bias to overcome the pressure drop across the ball poppet 67 to maintain such poppets on the upper seat 63 when the intake manifold pressure is low and to cause such ball poppet to be closed against the lower seat 59 when the partial vacuum is high, such as when engine is idling or unloaded at high RPMs. When the engine is operated under a heavy load at low R.P.M.'s, cruising under load or slowly accelerating the pressure drop cross the ball 67 will be sufficient to raise it off the lower seat 59 but insufficient to drive it against the top seat 63 thereby providing for limited air/fuel vapor flow therepast.

Thus, as the engine idles the partial vacuum will build up to a moderate level thus increasing the pressure differential across the poppet 51 to provide for calibrated flow through the calibrated passage 55. Only when the engine is operated at high R.P.M.'s without a load, decelerating or warming up under a choke condition is a sufficient vacuum developed to generate a sufficient pressure differential across the poppet 51 to drive the valve 17 open against the compression of the spring 45.

As long as the engine remains at idle, the partial vacuum communicated to the underside of the ball poppet 67 of the valve 21 is in sufficient to develop sufficient pressure differential thereacross to overcome the bias of the spring 75 resulting in the piston 73 maintaining the ball 67 seated against the lower seat 59. It will be appreciated that whenever either or both of the valves 17 and/or 21 are open, the flow through, and pressure drop across, the induction throat 33 will be correspondingly increased thus correspondingly increasing the flow of air/fuel vapor from the nozzle 35 thus emitting the air/fuel vapor mixture to the intake manifold. This increase in volumetric flow through the induction tubes 101 and into the flow passage 97 will tend to progressively increase the pressure in such passage 97. Such increased pressure will be communicated back through the lines 87 and 89 to the valve 17 and/or 21, thus leading to subsequent closure thereto. As the engine is loaded, as by acceleration, the partial vacuum in the intake manifold will decrease, thereby decreasing the magnitude of the partial vacuum in the flow passage 97 and consequently the pressure differential across the poppet 51 thereby resulting in the spring 45 urging the such poppet toward the seat 37 and diminishing the flow rate of air and vapor to the flow passage 97.

It will be appreciated by those skilled in the art that when the engine is loaded by slow acceleration, the resultant pressure differential on the valve 17 will be insufficient to effect opening thereof and also insufficient to effect closure of valve 21.

However, when the throttle is opened abruptly the vacuum in the intake manifold decreases resulting in the pressure differential to be insufficient to hold the ball poppet 67 on the lower seat 59.

In practice it has been found that engine performance is considerably improved when the positions of the valves 17 and 21 are as set forth in the following chart for the various engine operating conditions.

| ENGINE OPERATING CONDITION | DECLARATION VALVE 17 | ACCELERATION VALVE 21 |
|---|---|---|
| Off | Closed | Closed on upper seat |
| Start | Closed | Open from upper seat to close on lower seat (closed, open, closed) |
| Idle | Closed | Closed on lower seat |
| Low Acceleration | Closed | Open |
| High Acceleration (low vacuum) | Closed | Opening off upper seat and moving toward lower seat as vacuum increases |
| Loaded at Low RPM's | Closed | Open |
| Unloaded at High RPM | Open | Closed on lower seat |
| Cruise Without Load | Open | Closed on lower seat |
| Cruise With Load | Closed | Open off lower seat |
| Up Hill, Loaded | Closed | Closed on upper seat |
| Down Hill | Open | Closed on lower seat |
| When Decelerating | Open | Closed on lower seat |
| While Shifting Gears | | |
| Decelerate | Open | Closed on lower seat |
| Warming up With Choke | Open | Closed on lower seat |
| Initially upon turning off engine | Closed | Open, off lower seat |
| Engine Off | Closed | Closed on upper seat |

I have installed my controller of the present invention on a number of different models of engines and tests conducted thereon have demonstrated a significant improvement in performance and reduction of emissions. For a 1977 model Honda, Civic, 1500 C.C. engine the fuel economy was improved from 35 to 47.7 MPG for freeway driving. For a Buick Sky Hawk and Ford Capri, both with V-6 engines, the fuel efficiency was improved between 25% to 50% for various freeway driving conditions.

Further foregoing it will be apparent that the carburetor air and fuel vapor control apparatus of the present invention provides an economical and reliable means for enhancing the performance of an internal combustion engine to insure an improved fuel combustion and efficient operation.

I claim:

1. Carburetor air/fuel vapor control apparatus for controlling flow of air and fuel vapor from an air and vapor supply to the intake manifold of an engine and comprising:

an adaptor configured to be mounted under the mounting flange of the carburetor, said adaptor being formed with a flow passage and including an air and fuel vapor inlet port means and a perforated injection tube leading from said port and disposed in spanning relationship across said passage; and a controller including an air inlet passage formed with a reduced cross section induction passage, an air and fuel vapor inlet port for connection with said air and fuel vapor supply, vacuum port means for connection with said inlet port to said adaptor, said controller further including first and second control passages leading from said induction passage to said vacuum port means, first and second control valves for controlling flow in said first and second control passages, first and second control means for controlling said first and second valves, said first control means being operative in response to a predetermined partial vacuum at said vacuum port means to open said first valve to communicate flow of air and fuel vapor from said induction passage through said first control passage to said flow passage, said second control means being responsive to a selected partial vacuum at said vacuum port means, lower than said predetermined vacuum, to open said second valve to communicate flow of air and fuel vapor from said induction passage through said second control passage to said flow passage to combine with the flow through said first control passage whereby said controller will respond to said partial vacuum to open said first valve when said engine is decelerating and to open said second valve when said engine is subjected to high acceleration or cruising under a load.

2. Carburetor fuel vapor and air control apparatus as set forth in claim 1 wherein:

said first control valve includes a valve seat and poppet arranged to progressively increase the flow area defined therebetween as the magnitude of the partial vacuum at said vacuum port means progressively increases above said predetermined partial vacuum.

3. Carburetor fuel vapor and air control apparatus as set forth in claim 1 wherein:

said housing is formed to define first and second valve seats spaced axially apart in said second valve and said second valve includes a floating ball poppet interposed between said valve seats for selective seating thereon, said second valve control means including a control piston responsive to said selected pressure for shifting to a first position to release said ball poppet for disengagement from said first valve seat and further responsive to a partial vacuum higher than said pre-selected said selected partial vacuum to shift said control piston to a second position to free said ball poppet to close on said second seat to terminate flow from said flow induction passage through said second control passage to said flow passage.

4. Carburetor fuel vapor and air control apparatus as set forth in claim 1 where:

said second control means is responsive to a partial vacuum higher than said selected partial vacuum to close said second valve.

5. Carburetor fuel vapor and air control apparatus as set forth in claim 1 wherein:

said first valve includes a calibrated passage bypassing said valve to maintain air and fuel vapor communication to said flow passage when said first and second valves are closed.

6. Carburetor fuel vapor and air control apparatus as set forth in claim 1 wherein:

said adaptor includes a plurality of elongated coextensive, laterally spaced apart perforated injection tubes connected with said vapor inlet port means.

7. Carburetor fuel vapor and air control apparatus as set forth in claim 6 wherein:

said injection tubes are formed to define, in transverse exterior cross section, a streamlined configuration in the direction of flow through said flow passage.

8. Carburetor fuel vapor and air control apparatus as set forth in claim 1 wherein:

said adapter includes a plurality of elongated co-extensive lamination plates maintained in laterally spaced apart relationship in said flow passage and projecting in the direction of flow through said passage.

9. In an air/fuel vapor control apparatus for controlling flow of air and fuel vapor from an air and fuel vapor supply to the manifold of a carburetor of a carburated engine of the type generating a selected low vacuum in said carburetor during high acceleration of said engine, the improvement comprising:

tube means leading from said control apparatus to the manifold of said carburetor for communicating air and fuel vapor from such supply to said manifold and first and second valve means for controlling flow in said tube means, control means responsive to a predetermined partial vacuum sensed in said tube means to open said first valve means to introduce flow of a first rate to said tube means, said control means being responsive to said selected low vacuum, greater than said predetermined partial vacuum, to open said second valve means and increase the rate of flow through said tube means to said manifold of a carburetor whereby said first valve means will be open during decelerated, unloaded cruise and high R.P.M. engine conditions and said second valve means will be open during low and high acceleration condition of said engine.

10. An air/fuel vapor control apparatus as set forth in claim 9 wherein:

said control means is responsive to a partial vacuum greater than said selected high acceleration vacuum to close said second valve means.

11. An air/fuel vapor control apparatus as set forth in claim 9 wherein:

said second valve means includes a ball poppet.

12. An air/fuel vapor control apparatus as set forth in claim 9 wherein:

said control apparatus includes a calibrated passage for communicating flow from said air/fuel vapor supply means to said adapter flange beneath said carburetor when said first and second valve means are closed.

* * * * *